US006782972B1

(12) United States Patent
Hatch et al.

(10) Patent No.: US 6,782,972 B1
(45) Date of Patent: Aug. 31, 2004

(54) LADDER ELEVATOR DEVICE

(76) Inventors: Barlow Hatch, 555 Reed St., Santa Clara, CA (US) 95050; Burton Hatch, 555 Reed St., Santa Clara, CA (US) 95050

( * ) Notice: Subject to any disclaimer, the term of this patent is extended or adjusted under 35 U.S.C. 154(b) by 234 days.

(21) Appl. No.: 10/180,822

(22) Filed: Jun. 25, 2002

(51) Int. Cl.[7] ..... E06C 7/16; E04G 5/02
(52) U.S. Cl. ..... 182/102; 182/109; 182/107
(58) Field of Search ..... 182/102, 101, 182/107, 141, 214, 142, 129, 194, 180, 63.1, 104, 108, 109; 187/241, 402

(56) References Cited

U.S. PATENT DOCUMENTS 4,770,273 A * 9/1988 McMakin et al. ..... 182/129
4,793,437 A * 12/1988 Hanthorn ..... 182/102
4,875,547 A * 10/1989 Hanthorn ..... 182/102
4,911,266 A * 3/1990 McMakin et al. ..... 182/129

* cited by examiner

*Primary Examiner*—Hugh B. Thompson, II
(74) *Attorney, Agent, or Firm*—The Kline Law Firm

(57) ABSTRACT

An elevator device that is installed on a standard ladder, or for large lifting capacity installation, two or more ladders. In applications using two or more ladders, a base securing device can be added to each of the ladders to insure stability. The elevator device includes a ladder attachment assembly to affix the device to a ladder or ladders, a lateral travel section, and a roof top mounting device utilizing a T-bar support arm. A ladder stabilization bracket can be employed that affixes the ladder to a parapet or balcony for additional stability of the device. A winch raises the load from the ground, and then moves along the lateral travel section to provide lateral travel for the load on the roof top. Extension elements can be added to the lateral travel section so that the winch extends further onto a roof to reduce transport labor. The device can be easily adapted for use on flat roofs with a parapet through the addition of a ladder stabilization bracket. The elevator device can also readily be used on flat roofs without parapets, pitched roofs, and to load trucks. The ladder elevator device is operated by a handheld or foot operated control panel.

9 Claims, 18 Drawing Sheets

LADDER ELEVATOR DEVICE

BACKGROUND OF THE INVENTION

1. Field of the Invention

The present invention relates generally to construction equipment, and more particularly is a ladder mounted elevator device to raise loads.

2. Description of the Prior Art

People in the construction and building service industries are well aware of the many items that need to be raised to the roofs of various structures. The most common items to be lifted are of course the items that are installed on the roofs—roofing materials and heating, ventilating, and air conditioning equipment. These items are usually far to heavy to simply be carried up a ladder by a workman.

Various pieces of equipment have been utilized to resolve the elevating problem, among them cranes, cherry pickers, and helicopters. While these machines are certainly effective in raising the required loads, they are also expensive to operate, sometimes prohibitively so. Moreover, these machines require operating manpower in addition to that required for the actual installation at hand.

The prior art discloses many devices that have been proposed to address the problems of raising loads to a rooftop or to another elevated location. Various ladder hoists, hoist attachments, and ladder attachments to facilitate lifting have been offered for use in the painting, maintenance, HVAC, and construction trades.

Many such devices are essentially winches attached to a ladder, such as the "Lifting Device for Use with a Ladder" by Campbell, U.S. Pat. No. 5,911,287, issued Jun. 15, 1999. Another such device is the "Ladder Hoist Attachment" of Larson, U.S. Pat. No. 4,598,795, issued Jul. 8, 1986. Still another is the "Stabilized Ladder Power Winch System" of Pate, U.S. Pat. No. 5,139,108, issued Aug. 18, 1992. Still another is the "Extension Ladder Hoist" of Ziegelmann, U.S. Pat. No. 4,128,228, issued Dec. 5, 1978.

Other lifting devices incorporate a ladder or a ladder-like element with a hoist support arrangement to yield a portable hoist. One such device is the "Lift and Portable Lift" of Krotov, et al., U.S. Pat. No. 5,427,356. A similar device is the "Portable Hoist" of Killeen, U.S. Pat. No. 4,690,248, issued Sep. 1, 1987. A device that connects the hoist support to the terminal end of a ladder is the "Portable Swiveling Lift Device" of Sears, U.S. Pat. No. 5,738,185, issued Apr. 14, 1998.

The lack of widespread use of these prior art devices is attributable to their having one or more of the following shortcomings: (1) insufficient anchoring of the base of the ladder; (2) insufficient stabilization of the portion of the ladder from which the lifting force is applied; (3) lack of a safe and secure means of securing the upper end of the ladder; (4) the failure to provide sufficient power and mechanical advantage to lift large loads; (5) lack of easy portability; and (6) lack of compatibility with existing ladders.

Accordingly, it is an object of the present invention to provide a ladder elevator device that can be affixed to a standard ladder.

It is another object of the present invention to provide a device that has a stable base.

It is still another object of the present invention to provide a device that has adequate means of securing the lifting device to the roof top or other elevated area.

It is yet another object of the present invention to provide a device that is easily portable, but has adequate lifting power.

These and other objects and advantages of the present invention will become apparent to those skilled in the art in view of the description of the best presently known mode of carrying out the invention as described herein and as illustrated in the drawings.

SUMMARY OF THE INVENTION

The present invention is an elevator device that is installed on a standard ladder, or for large lifting capacity installation, two or more ladders. In applications using two or more ladders, a base securing device can be added to each of the ladders to insure stability.

The elevator device includes a ladder attachment assembly to affix the device to a ladder or ladders, a lateral travel section, and a roof top mounting device utilizing a T-bar support arm. A ladder stabilization bracket can be employed that affixes the ladder to a parapet or balcony for additional stability of the device.

A winch raises the load from the ground, and then moves along the lateral travel section to provide lateral travel for the load on the roof top. If desirable for a particular job, extension elements can be added to the lateral travel section so that the winch extends further onto a roof to reduce transport labor.

The device can be easily adapted for use on flat roofs with a parapet through the addition of a ladder stabilization bracket. The elevator device can also readily be used on flat roofs without parapets, pitched roofs, and even to load trucks.

The ladder elevator device of the present invention will typically be operated by a handheld control panel. Depending on the preference of the user, a foot operated control panel is also provided.

Another useful implementation of the present invention that should be noted, apart from the main function of a single elevator raising a load, is that two of the elevator devices can be employed in tandem to form a convenient portable and automated scaffold device.

An advantage of the present invention is that it is easily attached to all common ladders.

Another advantage of the present invention is that it is sturdy enough to have a very large lifting capacity.

A still further advantage of the present invention is that it includes a means to move the load across a rooftop, rather than to just lift the load to the roof.

Still another advantage of the present invention is that it has a means to secure the travel section of the device securely on the rooftop or other elevated area.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

The present invention is an elevator device 10 that is installed on a standard ladder 12, or for a large lifting capacity installation, two or more ladders 12. In applications using two or more ladders 12, a base securing device 14 is added to each of the ladders 12 to insure stability. Referring first to FIGS. 1–5, this description will begin with an overview of various preferred conformations of the device, with more detailed descriptions of the various components following thereafter. The elevator device of the present invention can be assembled in several different ways depending on the specific application.

Figure 1:
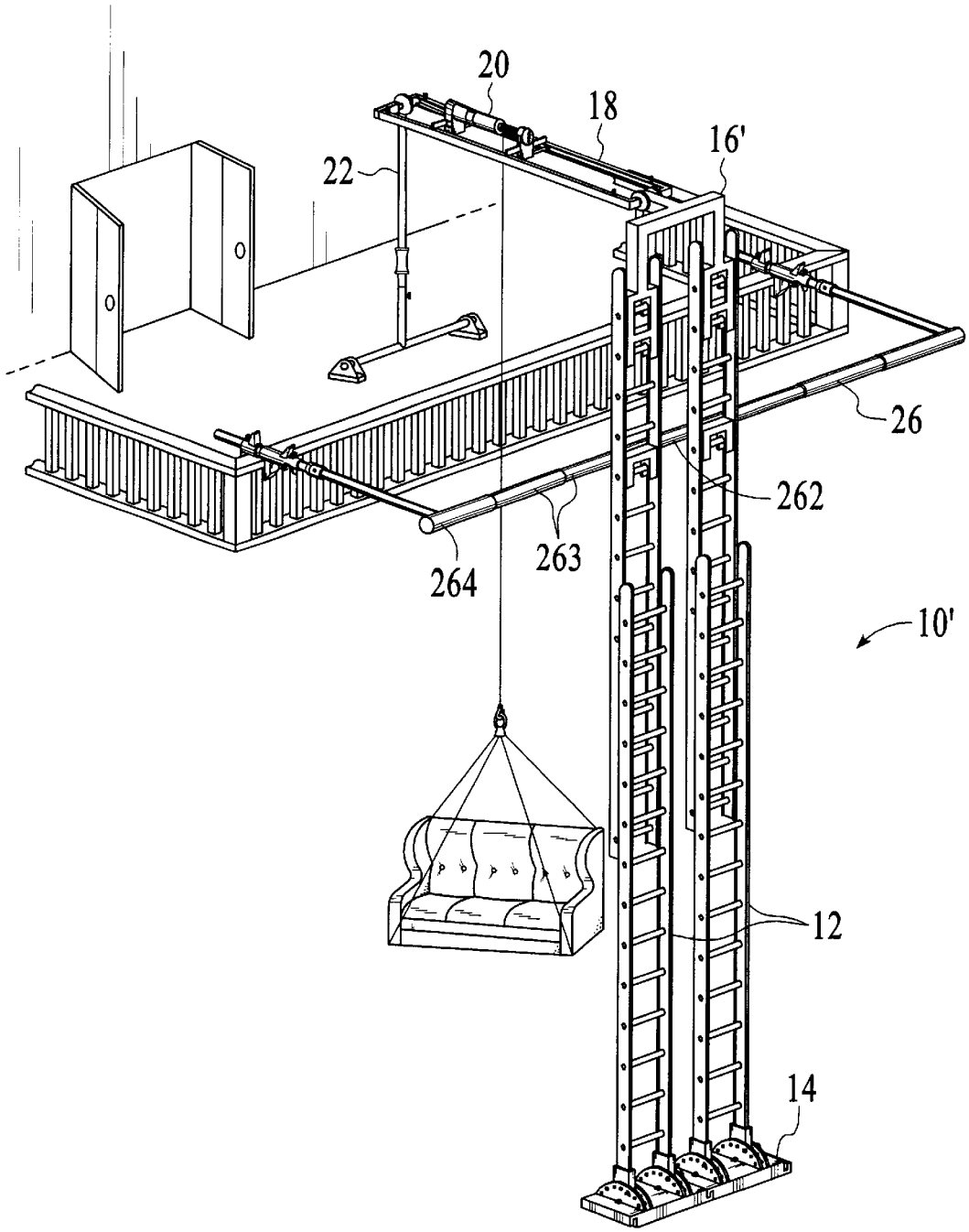
FIG. 1 is a perspective view of the ladder elevator device of the present invention mounted on a dual locked ladder base with a ladder stabilization bracket in use on a balcony.

FIG. 1 illustrates an installation of the ladder elevator device 10' for high elevations and/or heavy loads. A pair of extension ladders 12 with a dual locked ladder base securing device 14 is used to provide adequate support for the system. A branched ladder attachment assembly 16' is utilized to anchor the device to both the ladders 12. A lateral travel section 18 is pivotally attached at a first end to the ladder attachment assembly 16'. A winch 20 is mounted on the lateral travel section 18 to raise the load and to move the load laterally when it reaches the desired height. A T-bar support 22 is affixed to the distal end of the lateral travel section 18 to hold the lateral travel section 18 in a horizontal position. At each end of the lateral travel section 18, rotation brake elements 24 are supplied to inhibit rotation of the ladder 12 and the T-bar support 22 relative to the lateral travel section 18. The elevator device 10' shown in FIG. 2 also makes use of a telescoping ladder stabilization bracket 26.

Figure 2:
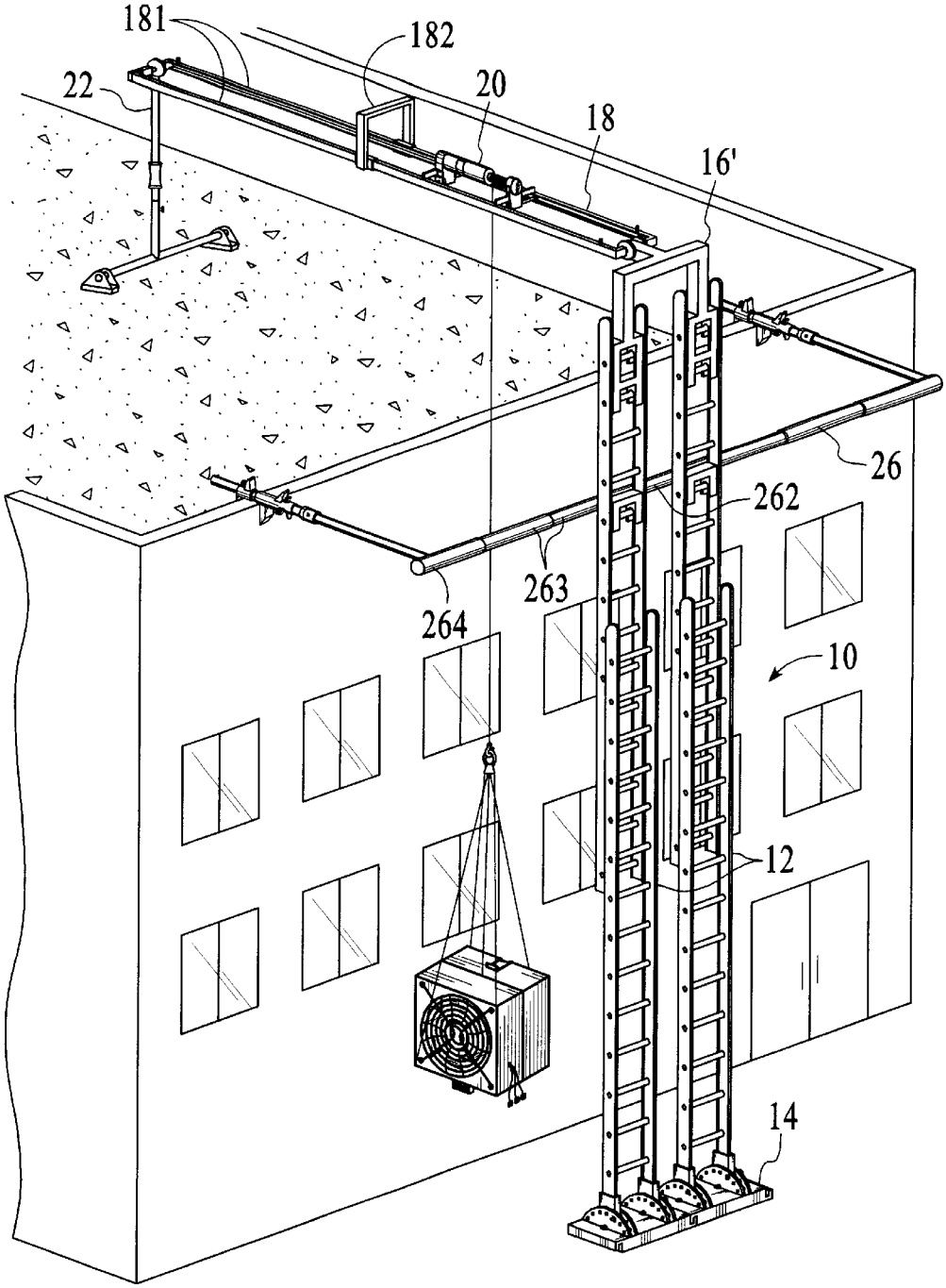
FIG. 2 is a perspective view of the ladder elevator device mounted on a dual locked ladder base in use on a flat roof with a ladder stabilization bracket.

FIG. 2 shows the dual ladder elevator 10' deployed on a building with a flat roof with a parapet. The parapet provides an ideal anchoring point for the telescoping ladder stabilization bracket 26.

Figure 3:
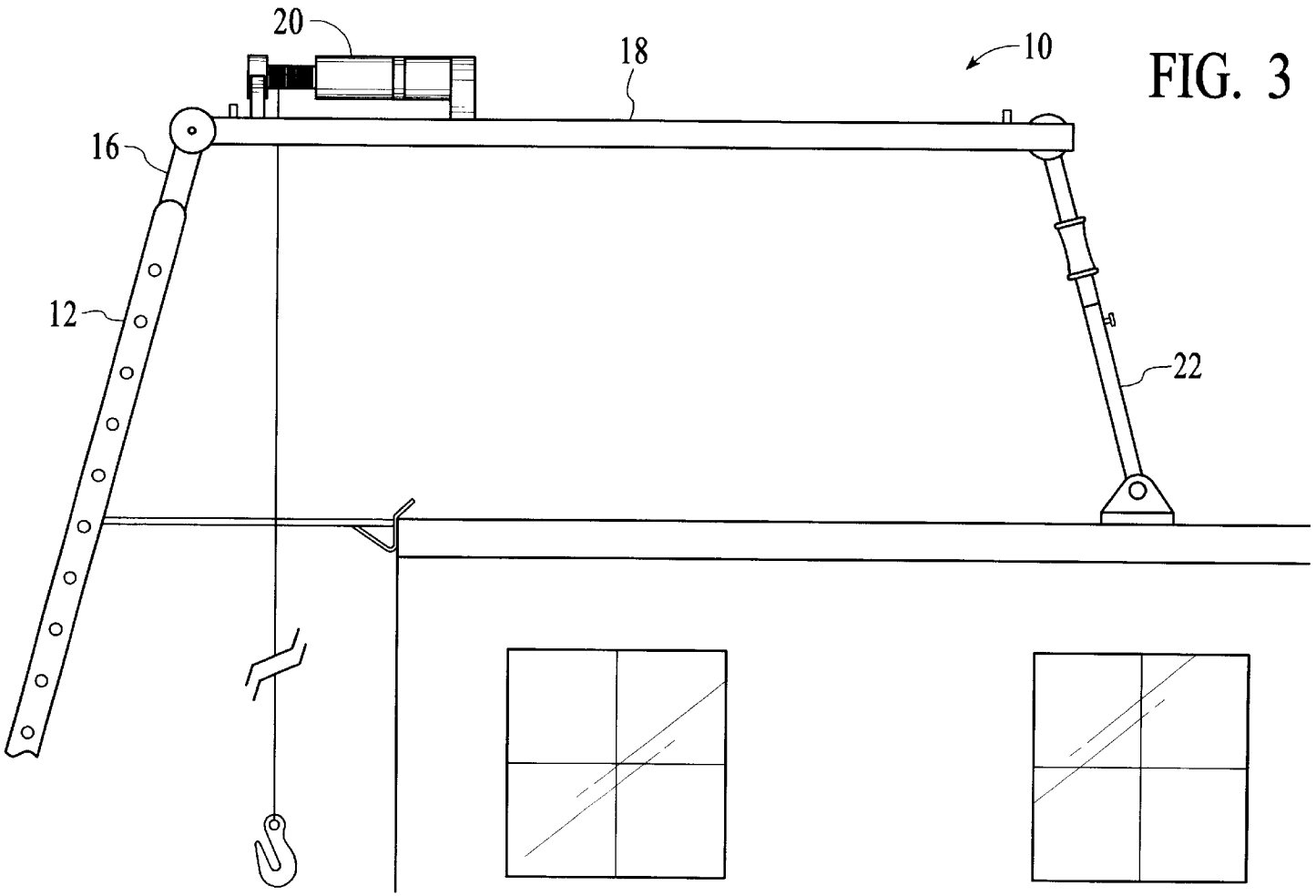
FIG. 3 is a side view showing the ladder elevator device in use on a flat roof with no ladder stabilization bracket.
Figure 4:
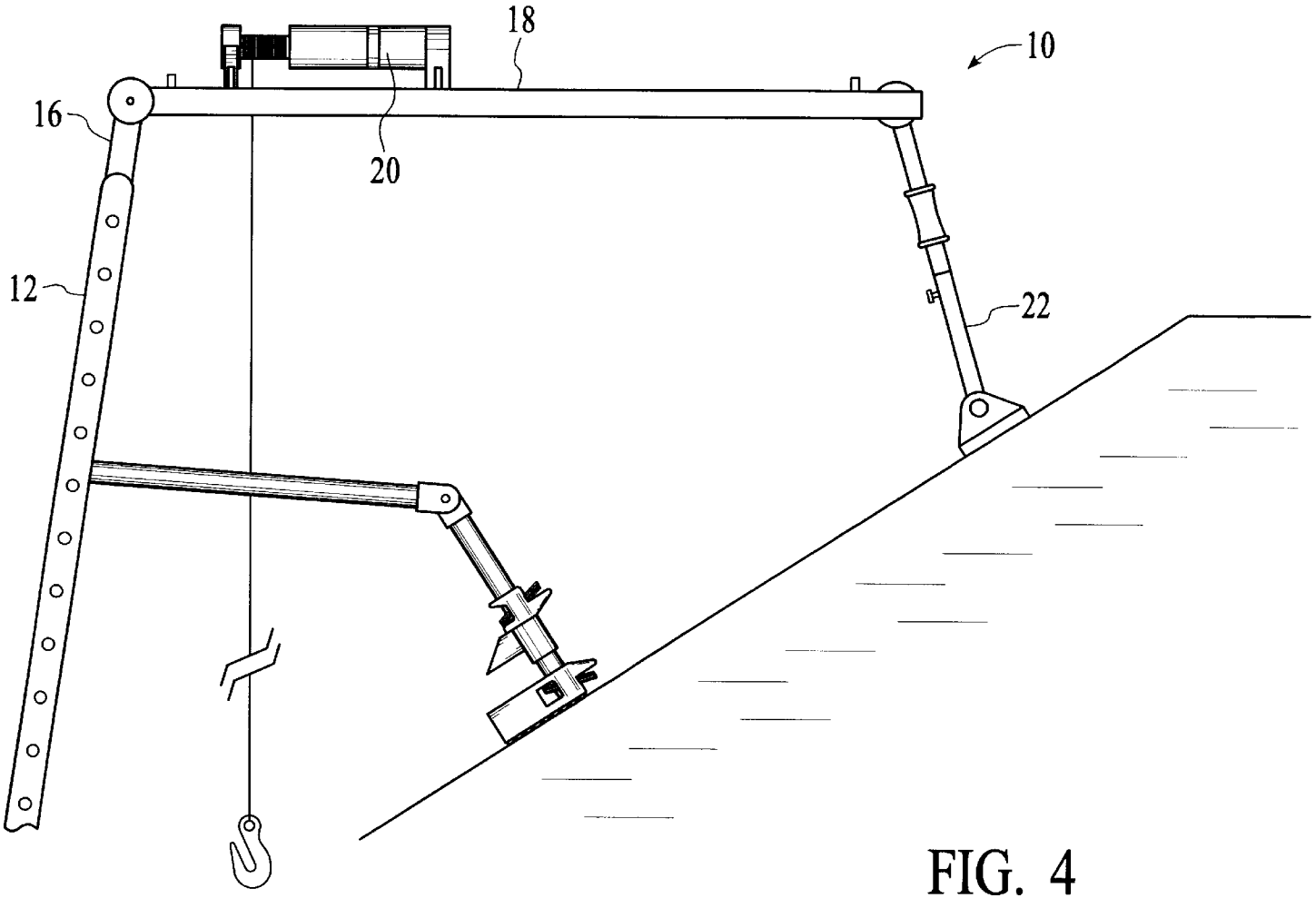
FIG. 4 is a side view of the ladder elevator device in use on a typical slanted roof with no ladder stabilization bracket.

FIG. 3 shows the single ladder elevator 10 installed on a flat roof with no parapet. This installation requires that the ladder 12 be angled toward the roof, and that the T-bar support 22 be angled toward the ladder 12. It is recommended that the angles of inclination of the ladder 12 and the T-bar support 22 be equal and opposite. FIG. 4 shows the same elevator 10 conformation, but installed on an angled roof. It should be noted that the ladder stabilization bracket 22 can be used for applications such as those shown in FIG. 3 and FIG. 4 where there is no parapet or balcony on which to attach the bracket 26. In such an instance, the ladder stabilization bracket 26 would simply be propped against the edge of the roof. If desired by the user, the outer ends of the clamping mechanisms 266 of the bracket 26 can include a concave curved or angled element to better grip the edge of the roof.

Figure 5:
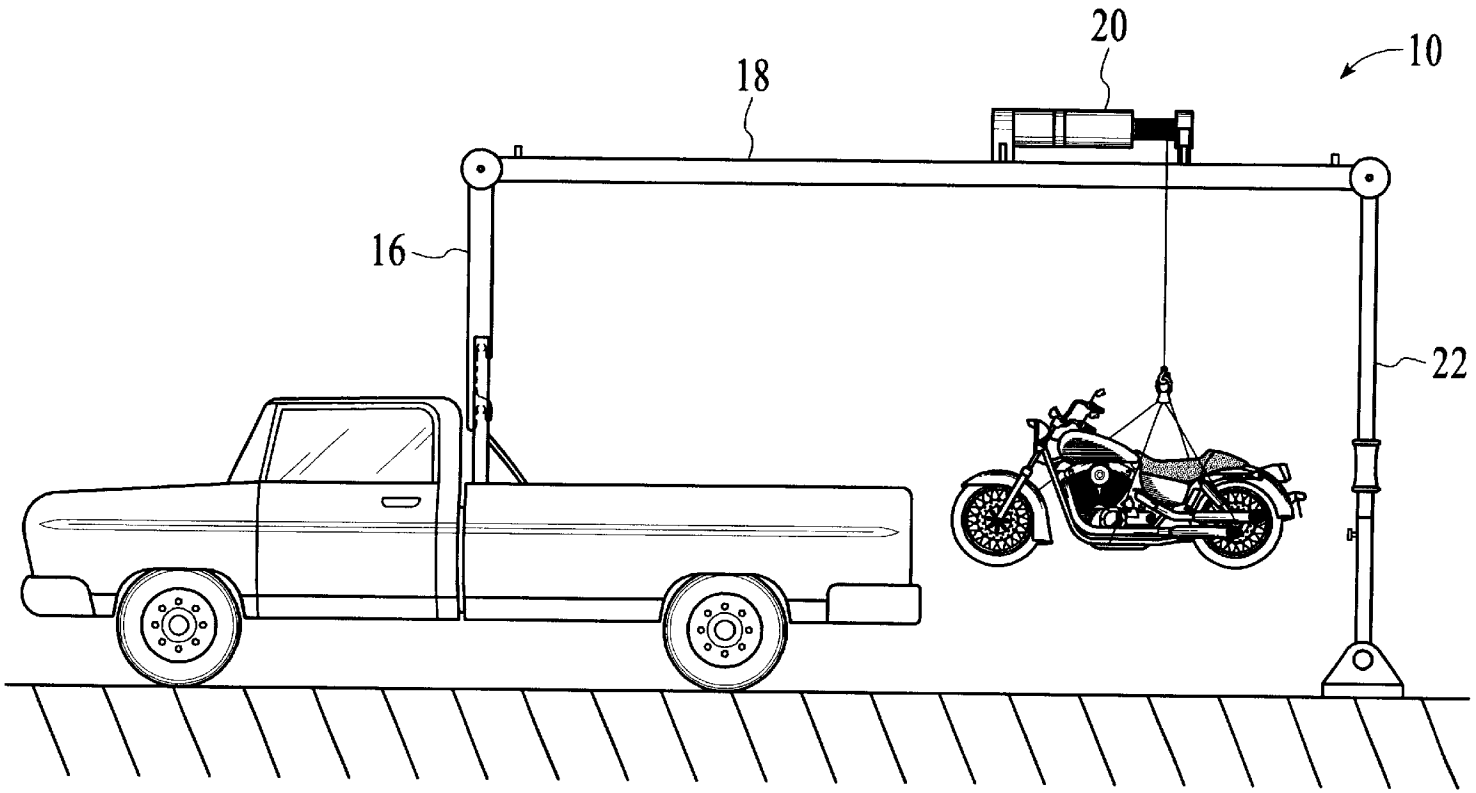
FIG. 5 is a side view showing the ladder elevator device being used to load a truck.

FIG. 5 illustrates an alternate usage of the ladder elevator device 10 of the present invention. FIG. 5 shows the elevator 10 being used to load a truck. In this application, the ladder attachment assembly 16 is secured at the front end of the bed of the truck, either on a ladder or on a rack integral to the truck. The T-bar support 22 is placed on the ground. The user secures the load to the winch 20, raises the load, and places the load in the truck bed by moving the winch 20 along the lateral travel section 18 of the device 10. It is advantageous to disassemble the ladder elevator device 10 before moving the truck.

Figure 6:
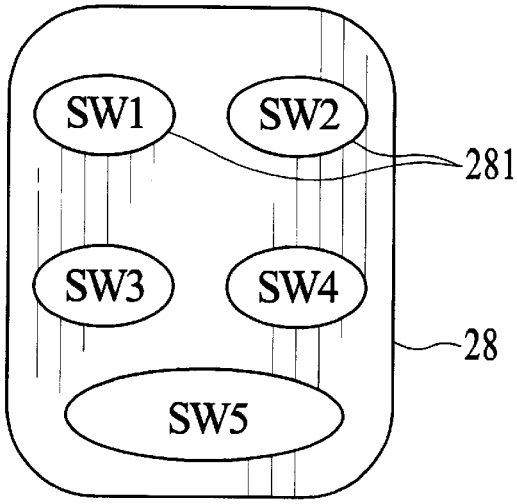
FIG. 6 illustrates a handheld control panel for the ladder elevator.
Figure 7:
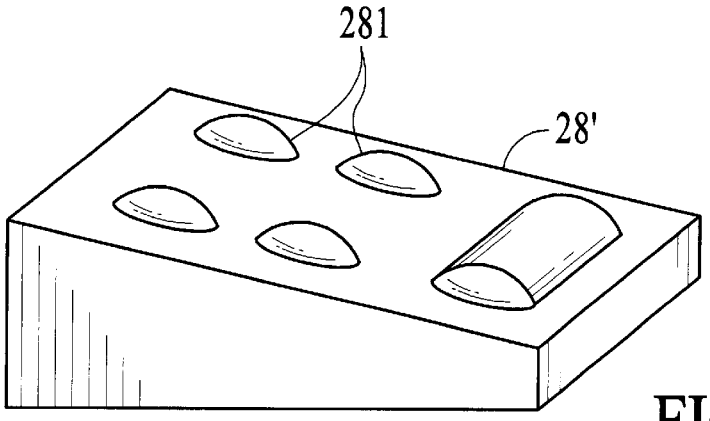
FIG. 7 shows a foot operated control panel for the ladder elevator.

Operation of the winch 20 is regulated by either a handheld control panel 28 (as shown in FIG. 6), or a foot operated control device 28' (FIG. 7). The control panel 28, 28' comprises a plurality of buttons 281 that control at least the rotational brakes 24, the winch 20 raising and lowering of the load, and the winch 20 lateral travel.

Figure 8:
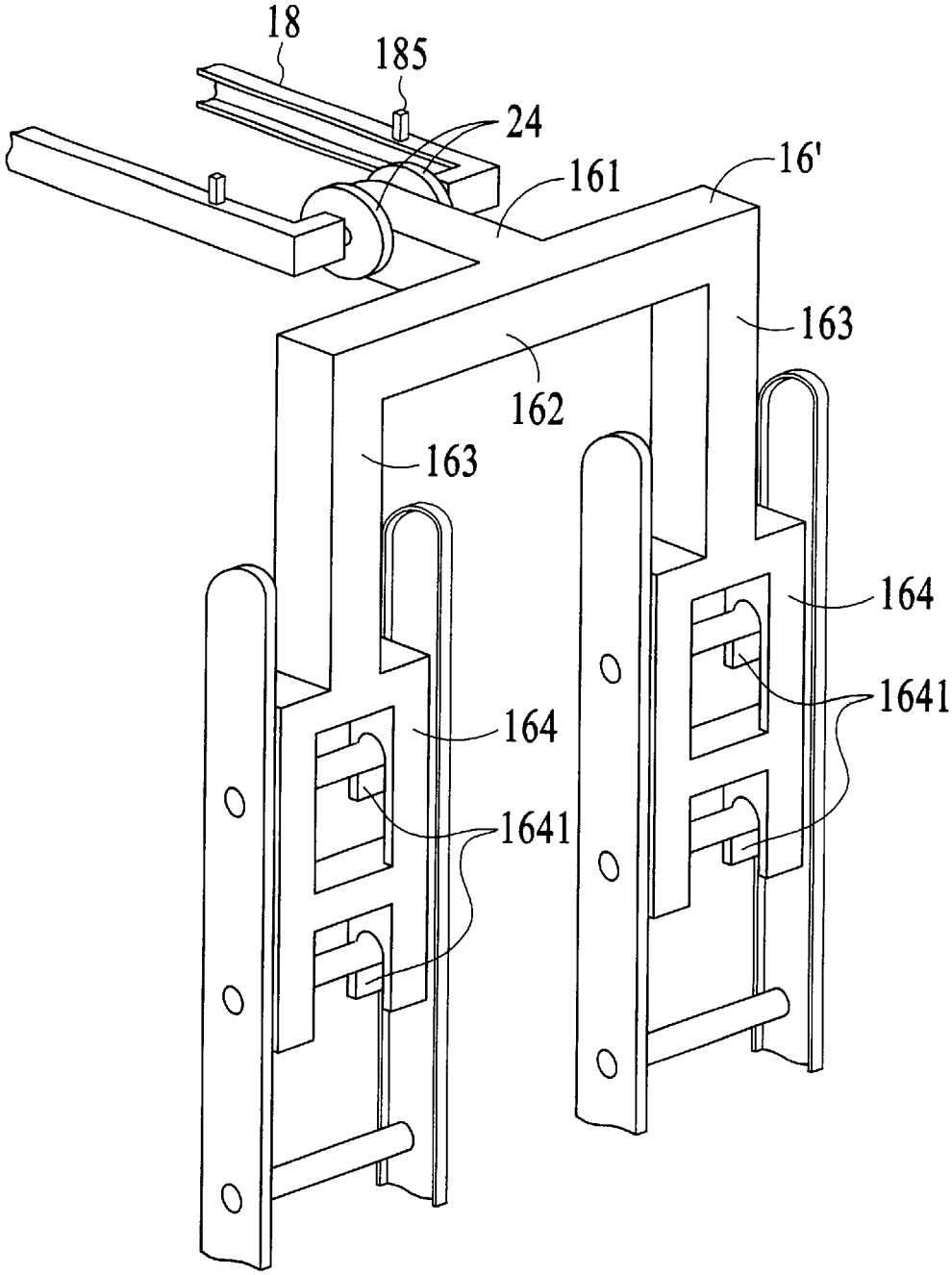
FIG. 8 is a perspective view of the ladder mounting assembly.

The ladder elevator device of the present invention is easily mounted on a standard ladder 12. FIG. 8 shows the branched ladder attachment assembly 16' securing the dual ladder elevator 10' to the tops of the ladders 12. The ladder attachment assembly 16' comprises an attachment arm 161 that is pivotally attached to the first end of the lateral travel section 18. The attachment arm 161 connects to a lateral branch arm 162. Two mounting arms 163 extend downward from the branch arm 162. The mounting arms 163 terminate in a rung attachment means 164.

The rung attachment means 164 comprises a plurality of rung hooks 1641 configured to fit over the rungs of the ladder 12. In the embodiment shown in FIG. 8, two sets of paired rung hooks 1641 are used. As is shown in FIG. 9, the user may employ a third set of rung hooks 1641 if he so desires to add additional stability to the device.

Figure 9:
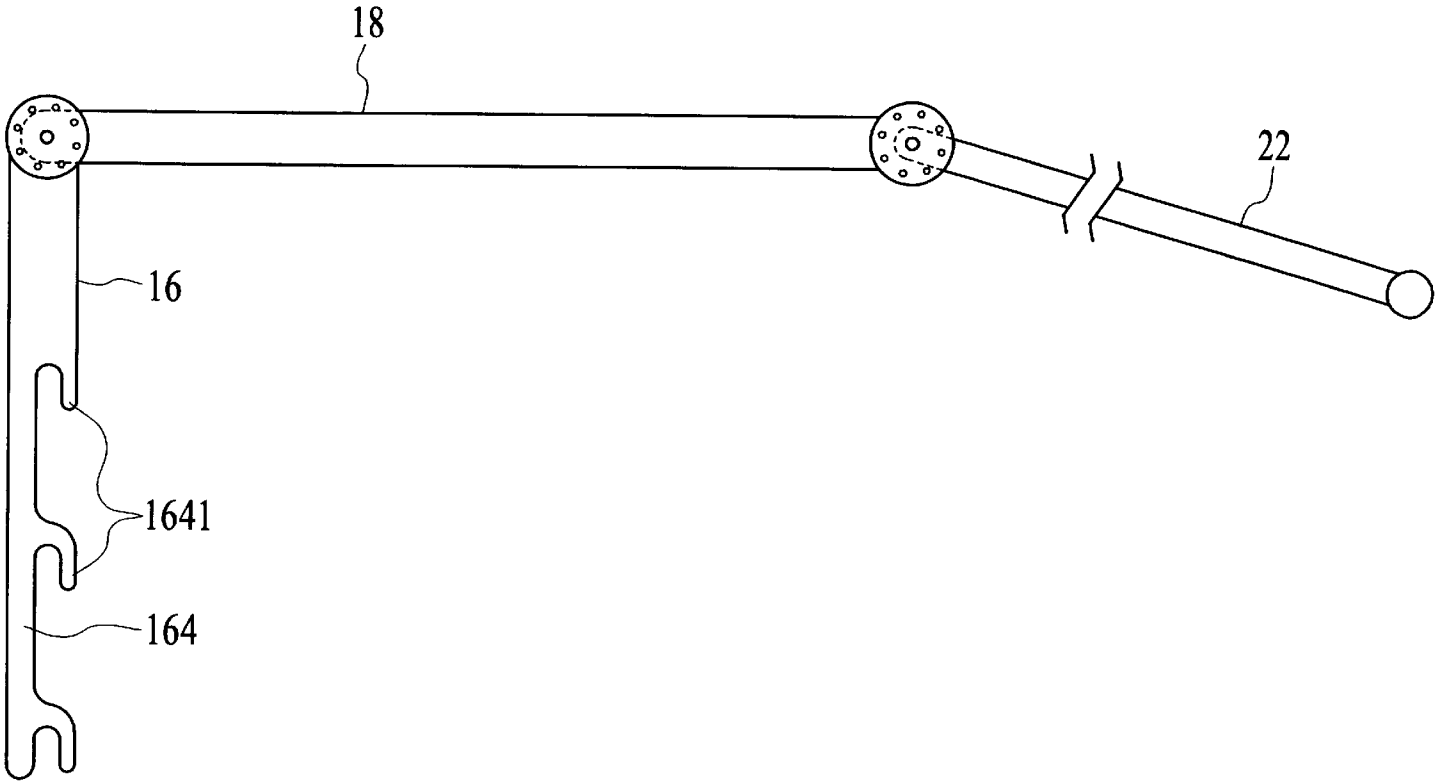
FIG. 9 is a side view of the ladder mounting assembly showing an additional rung attachment means.

In FIG. 9, a single element ladder attachment assembly 16 is shown. The single element ladder attachment assembly 16 comprises simply a rung attachment means 164 pivotally connected to the first end of the lateral travel section 18.

It should also be evident to those skilled in the art that the rung hooks 1641 on the rung attachment means 164 need not be in pairs, but could be single elements, or in groups of three or more. However, at least two rungs of the ladder 12 should always be secured by the rung attachment means 164 of the ladder attachment assembly 16, 16' so that the ladder attachment assembly 16, 16' does not rotate about the end of the ladder 12.

Figure 10:
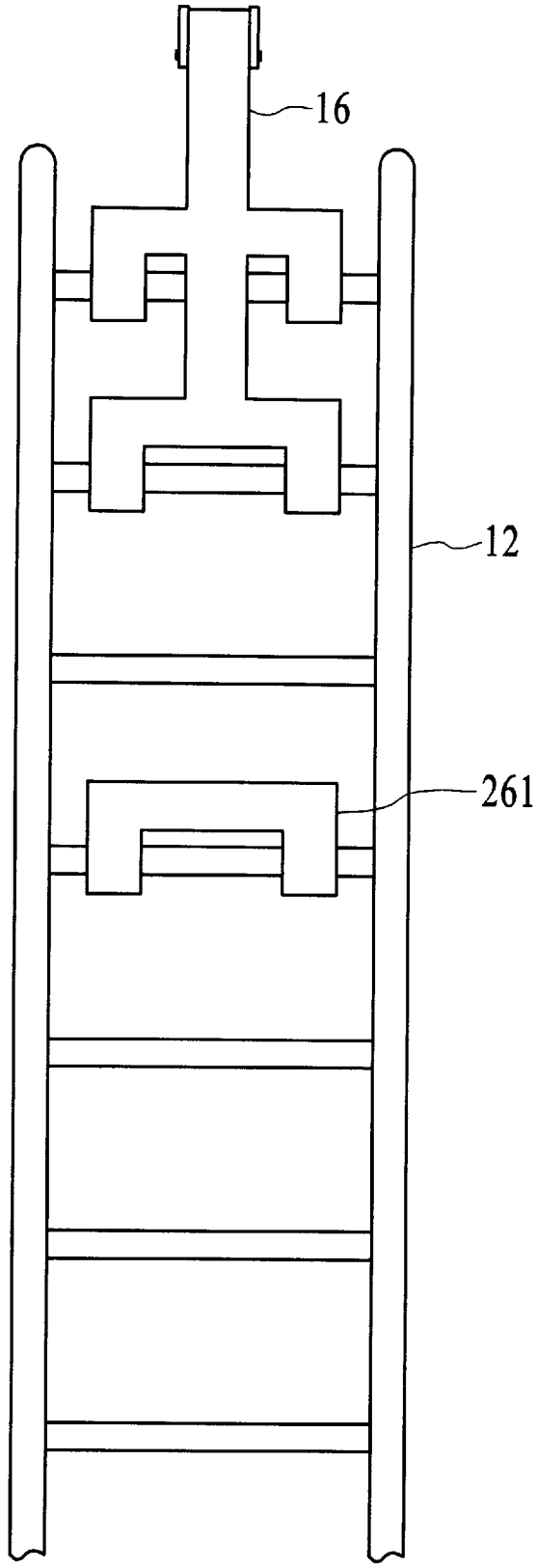
FIG. 10 is a straight on view showing the ladder mounting assembly and the ladder stabilization bracket affixed to the ladder.

FIG. 10 shows a straight on view of the ladder 12 with the ladder attachment assembly 16 and the ladder stabilization bracket 26 in place. The telescoping ladder stabilization bracket 26 with a dual ladder attachment is shown in a deployed position in FIGS. 1 and 2. The dual ladder stabilization bracket 26 comprises two rung attachment means 261 to affix the bracket 26 to the ladder 12, while the single ladder version illustrated in FIG. 10 utilizes only one rung attachment means 261.

In both the single and dual ladder configurations, the rung attachment means 261 is affixed to a central mounting bar 262. A plurality of nesting extension segments 263 are provided to extend the bracket 26 outward from the ladder 12. Clamping arms 265 are affixed to the terminal extension segments 263. The clamping arms 265 each terminate in clamping mechanisms 266 that secure the ladder stabilization bracket 26 to a parapet (FIG. 2), a balcony railing (FIG. 1), or simply an edge of a roof.

Figure 11:
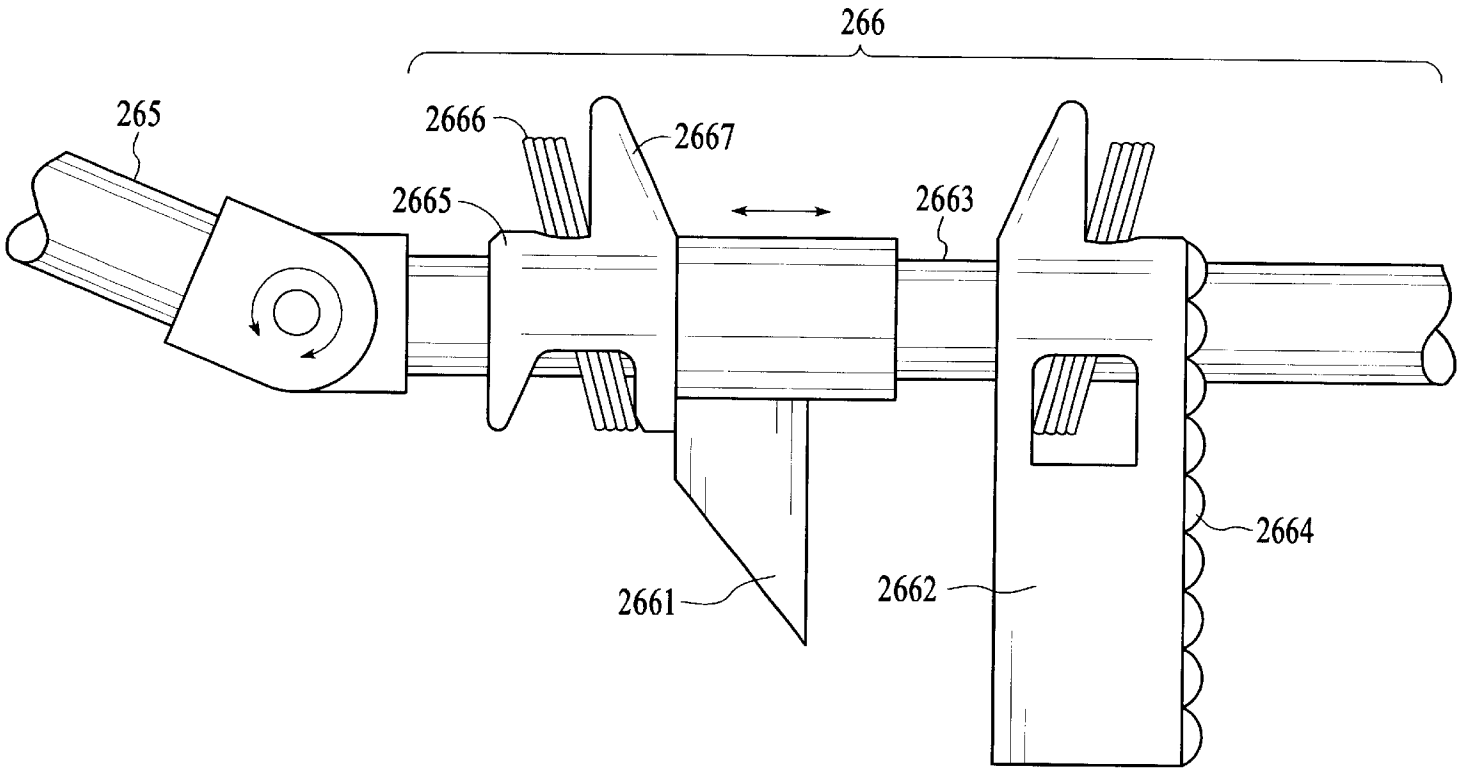
FIG. 11 is a detail view of the ladder stabilization bracket clamping mechanism.

FIG. 11 is a detail view of the clamping mechanism 266 of the ladder stabilization bracket 26. The clamping mechanism 266 comprises an inner jaw 2661 and an outer jaw 2662 mounted on a rod 2663. The outer jaw 2662 is covered by a compressible pad 2664 formed from, e.g. rubber. The inner jaw 2661 of the clamp is affixed to a sliding locking means 2665. The locking means 2665 includes a release plate 2666 that is pivotally mounted adjacent to a projecting grip 2667 of the locking means 2665. The locking means is released by a user pressing the release plate 2666 toward the projecting grip 2667 so that the release plate 2666 is moved toward a position perpendicular to the rod 2663. When the locking means is in the desired position, the user releases the release plate 2666, which returns to its locked position angled relative to the rod 2663. The release plate 2666 is made from a material that is somewhat such as rubber to ensure that the locking means 2665 stays in the desired position. To ensure that the clamping mechanism 266 can be securely attached regardless of the exact position of the ladder 12, the clamping mechanism 266 is pivotally affixed to the clamping arm 265.

Figure 12:
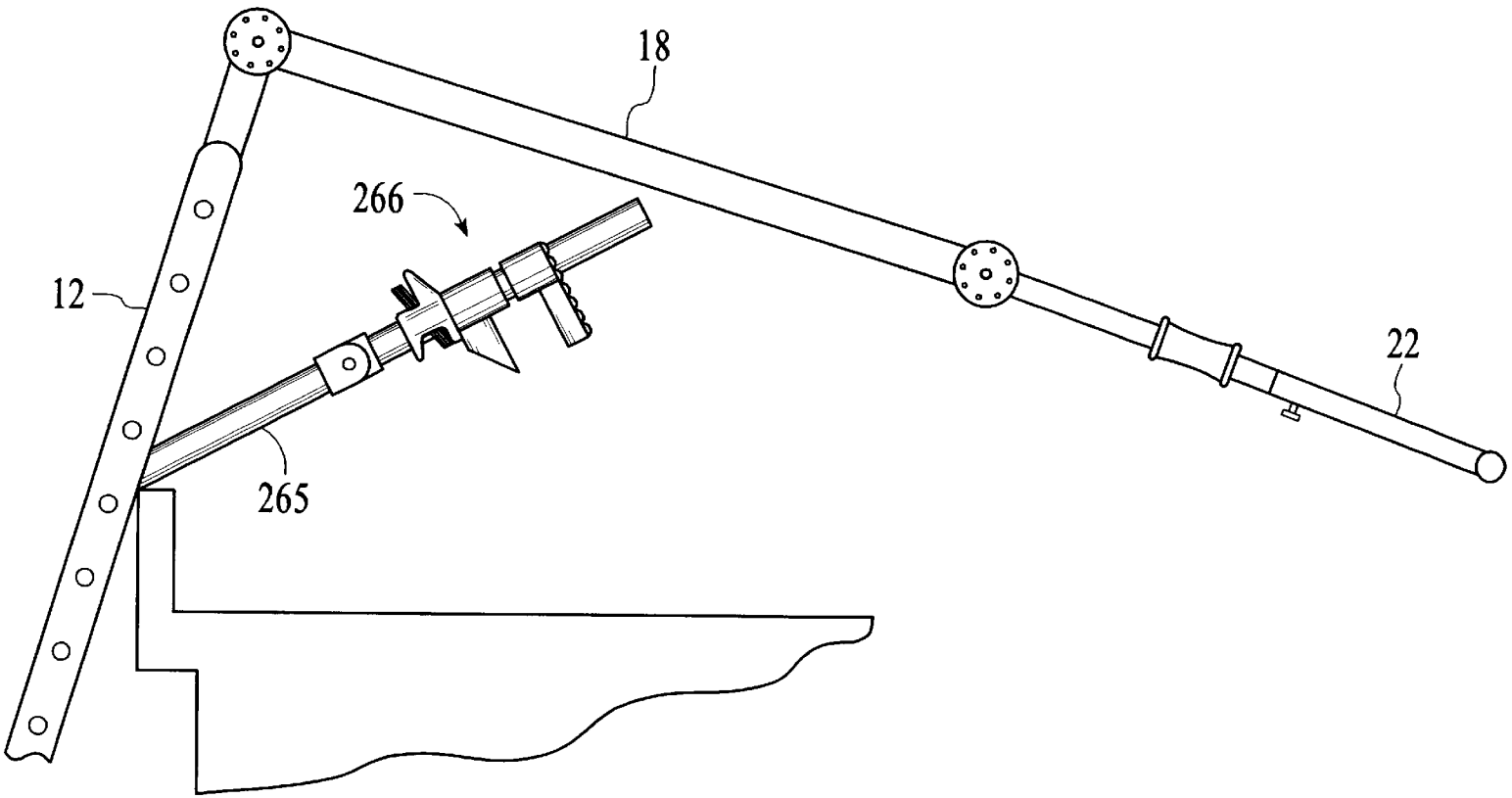
FIG. 12 is a side view illustrating the ladder elevator device as it is leaned against a flat roof with a parapet to begin the setup procedure.
Figure 13:
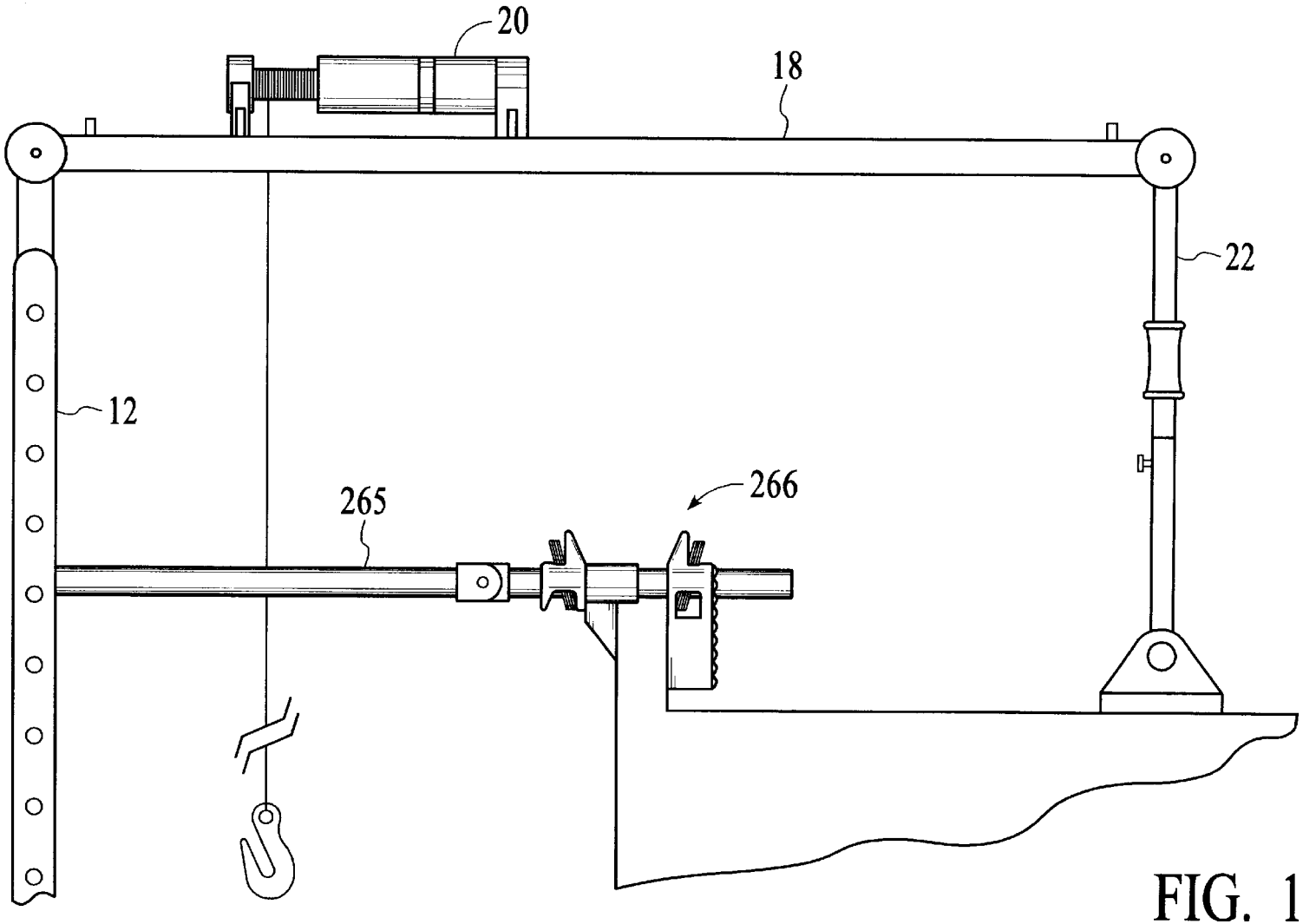
FIG. 13 is a side view illustrating the ladder elevator device after it has been secured on a flat roof with a parapet.

Deployment of the stabilization bracket 26 of the ladder elevator device 10, 10' of the present invention is best understood with reference to FIGS. 12 and 13. FIG. 12 shows the ladder 12 of the elevator device 10, 10' after the device has been unloaded from the user's truck and leaned against the parapet of a roof. The user climbs up the ladder 12 when the ladder is in the position shown in FIG. 12, and then secures the elevator device 10, 10' as shown in FIG. 13. The T-bar support 22 is moved to the supporting position, which may be either vertical or angled depending on the specific application, and the clamping mechanisms 266 of the ladder stabilization bracket 26 are secured to the top of the parapet.

Figure 14:
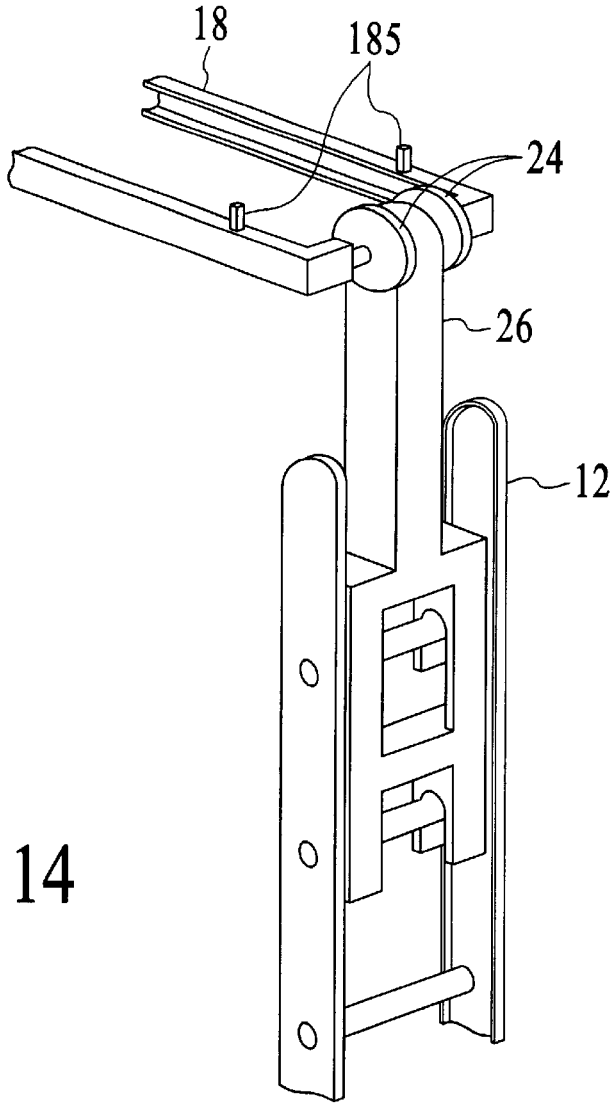
FIG. 14 shows the brake elements at the connection joint between the upper end of the ladder mounting assembly and the outer end of the lateral travel section.
Figure 15:
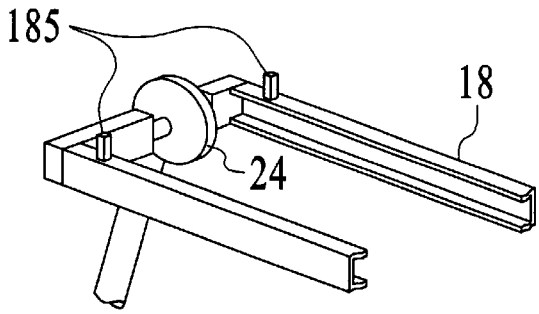
FIG. 15 shows the brake element on the joint between the inner end of the lateral travel section and the upper end of the T-bar support.

The ladder elevator device 10, 10' is prevented from excessive motion ("flopping around") during installation by brake elements 24 installed at each end of the lateral travel section 18 as depicted in FIGS. 14 and 15. FIG. 14 shows the brakes 24 at the pivot point of the lateral travel section 18 and the ladder attachment assembly 16, 16', and FIG. 15 shows the brake at the pivot point of the lateral travel section 18 and the T-bar support 22. The brake elements 24 are typically spring loaded and include a triggering device, such as a solenoid, that secures and release the brake 24. The brakes 24 are normally on, and will be released only when power is applied to the triggering devices by the control panel 28, 28'. Therefore the ladder attachment assembly 16, 16', and the T-bar support 22 rotate about the pivot points with the lateral travel section 18 only when the user activates the appropriate button 281 on the control panel 28, 28'.

Figure 16:
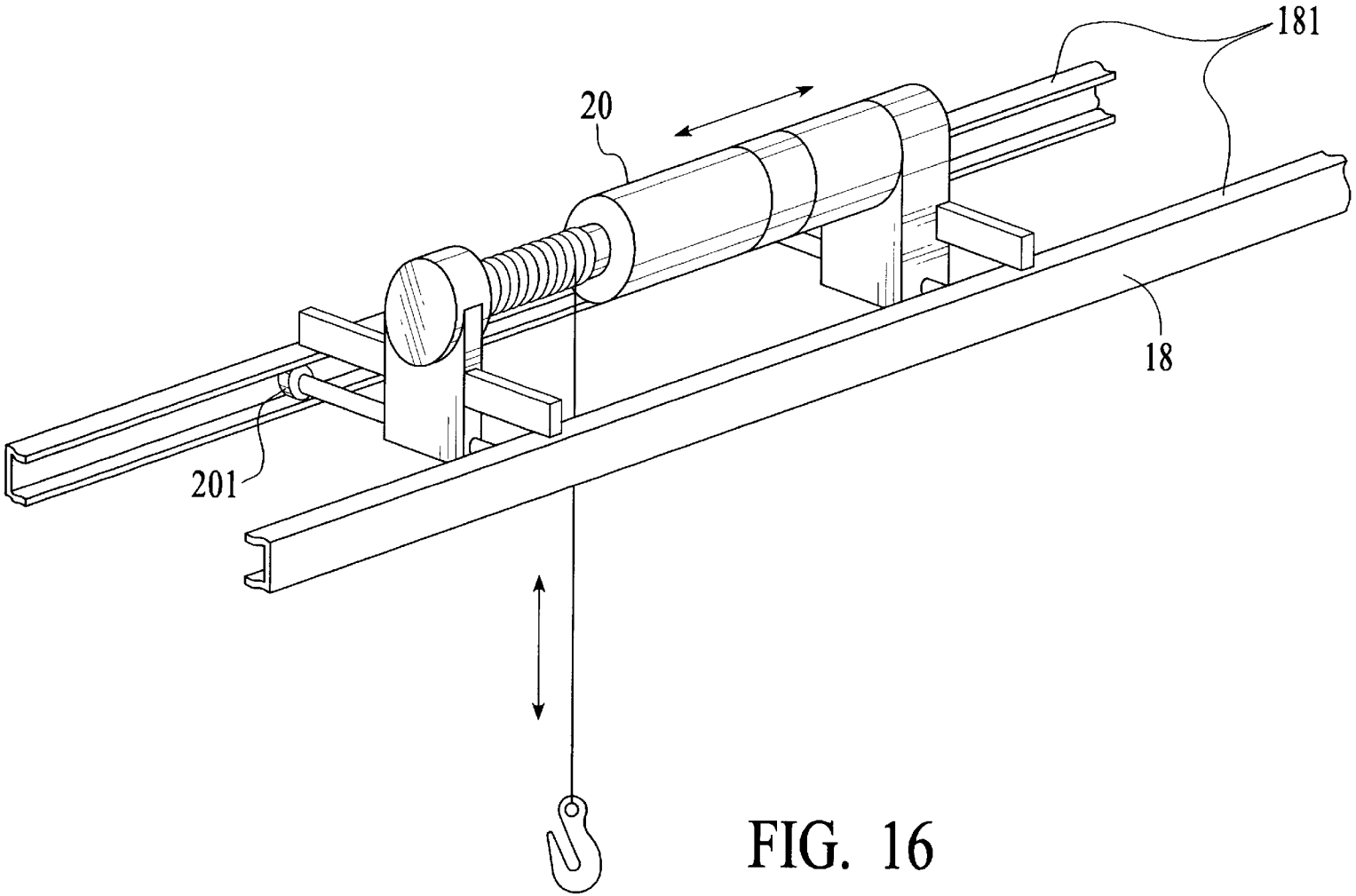
FIG. 16 is a perspective view of the winch on the lateral travel section.

FIG. 16 shows the winch 20 mounted on a plurality of wheels 201 that are secured in the interior of the track elements 181 of the lateral travel section 18. The winch 20 is a known prior art device with lifting and lateral travel capability. Any of several such commercially available winches are suitable for the present invention, and are thus not discussed in further detail herein. The travel path of the winch is limited of course by the ends of the lateral travel section 18, and by winch travel stops 185 on the upper sides of the terminal track elements 181 near the ends of the lateral travel section 18.

Figure 17:
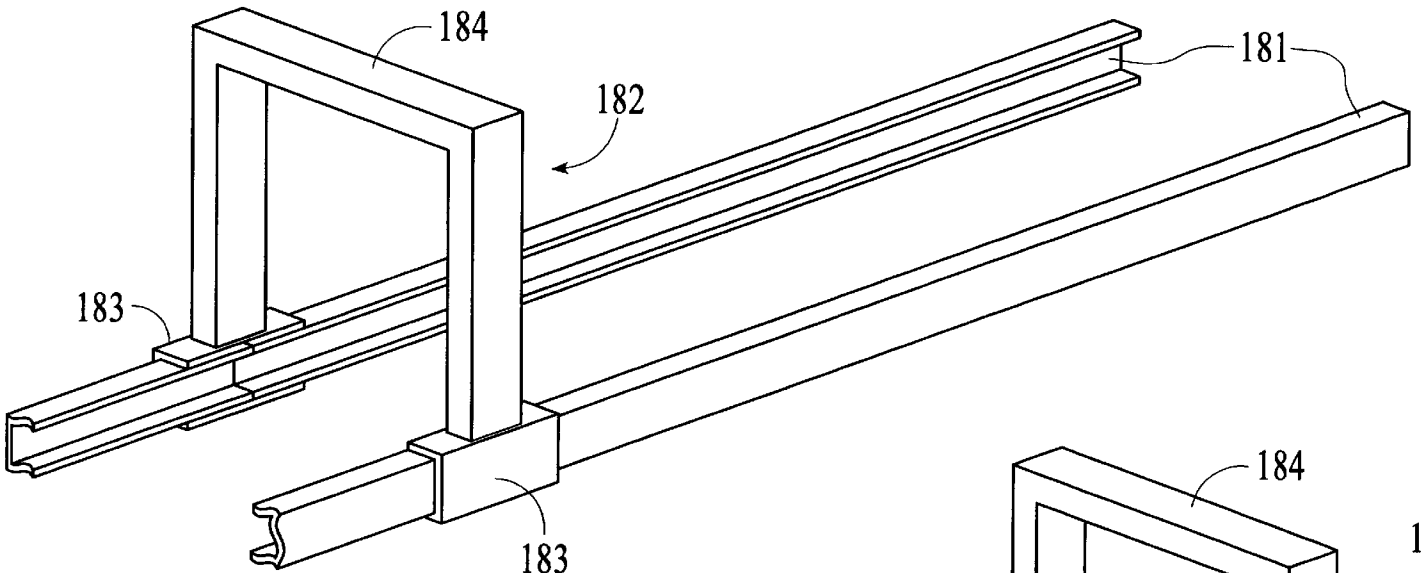
FIG. 17 illustrates a method to add length to the lateral travel section.
Figure 18:
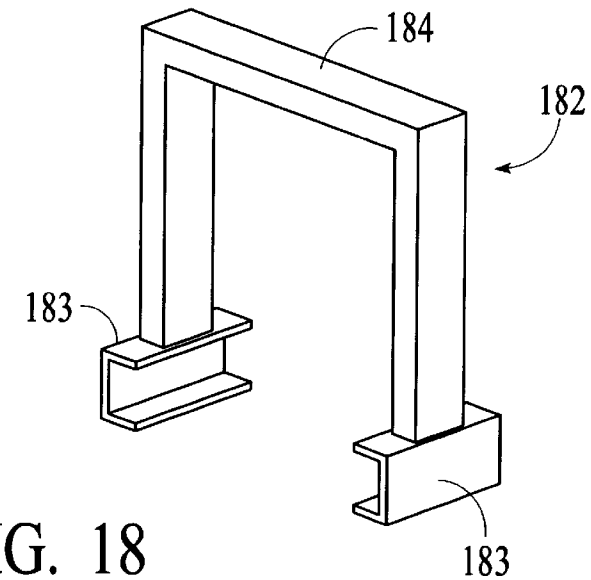
FIG. 18 shows a detached coupling means to join multiple sections of the lateral travel track bars.

If the job site is a large roof, further horizontal travel capability may be beneficial. In such a case, two or more additional track elements 181 can be added to the lateral travel section 18 as depicted in FIG. 17. The additional track elements 181 are joined together by a track coupling means 182, shown in detail in FIG. 18. The track coupling means 182 comprises a pair of track receiving means 183 that receive and secure the ends of a pair of aligned track elements 181 so that a single continuous lateral travel track is formed. A joining bar 184 can be used to connect the two track receiving means 183 so as to add stability to the assembly. The track coupling means 182 have an open interior so that the interior of the track elements 181 are not restricted, thereby allowing a free travel path for the wheels 201 of the winch 20. To the same end, the joining bar 184 extends upward from the receiving means 183, then laterally across the width of the tracks 181, thereby forming an open and raised central area that serves as a passageway for the winch 20 as it moves along the lateral travel section 18.

Figure 19:
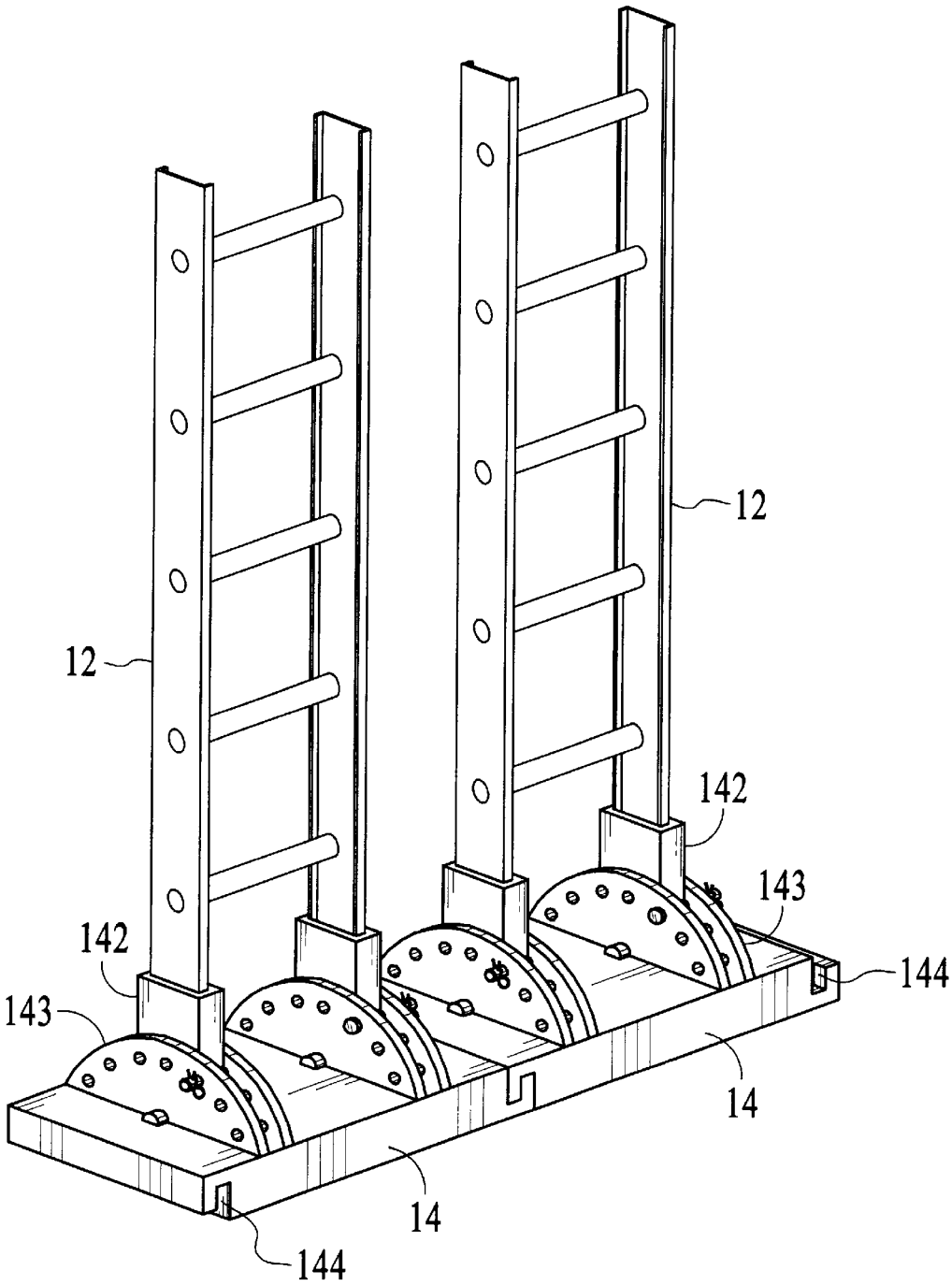
FIG. 19 is a perspective view of the ladder base securing device on a dual locked ladder base.
Figure 20:
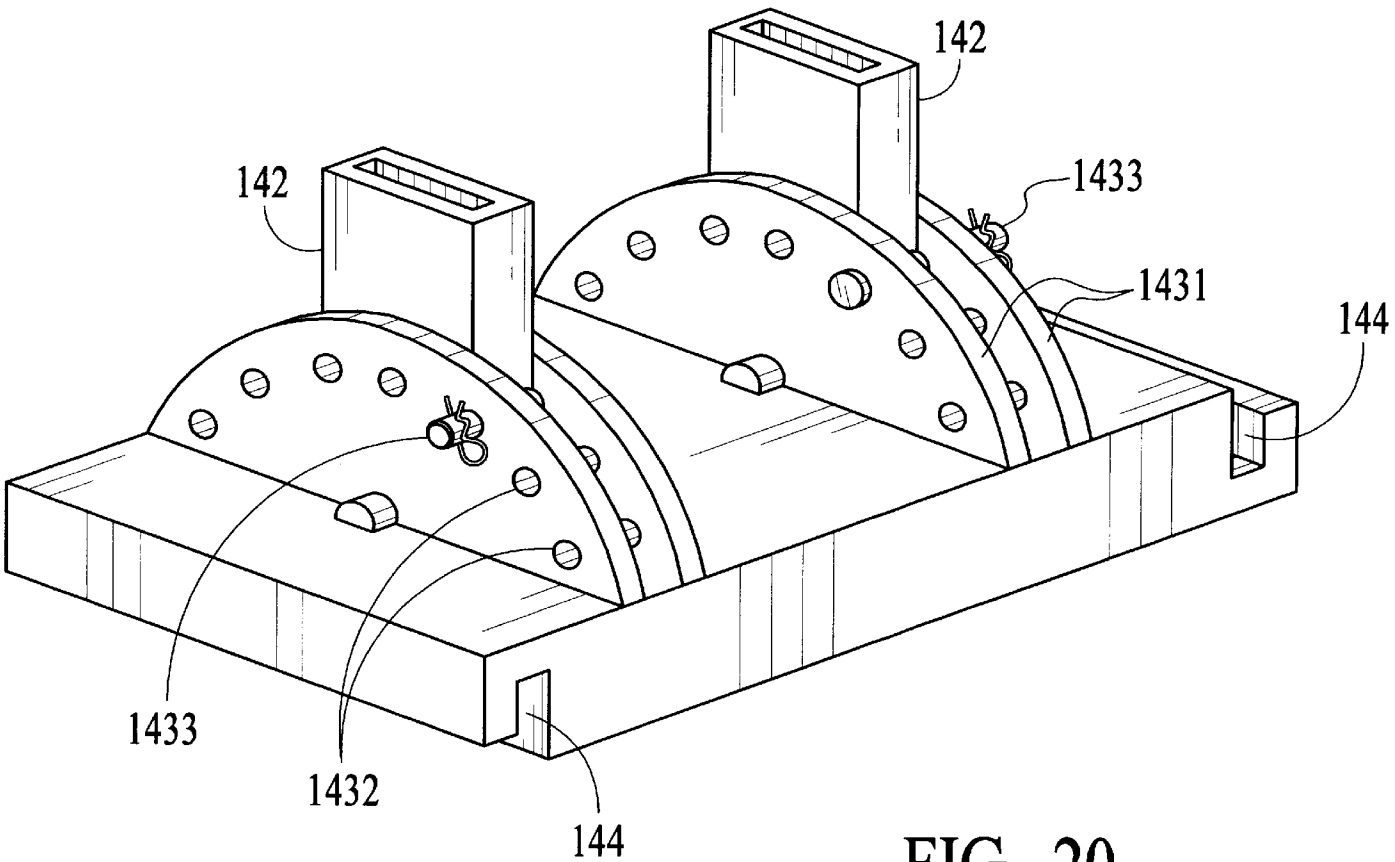
FIG. 20 shows a detached ladder base securing device.

For the dual ladder elevator 10' embodiment of the present invention, it has been found that a dual locked ladder base securing device 14 should be used for stability of the system. The ladder base securing device 14 is most easily seen in FIGS. 19 and 20. The ladder base securing device 14 comprises a heavy base element 141 with a pair of ladder rail sockets 142 pivotally mounted thereon. The rail sockets 142 are contained in angle locking means 143. The angle locking means 143 comprise a pair of parallel semicircular plates 1431 with a plurality of locking positions defined therein. In the preferred embodiment, the locking positions are defined by a series of holes 1432 that selectively receive a locking pin 1433. The position of the locking pin 1433 defines the maximum angle through which the rail sockets 142, and hence the ladder rails, can be moved. Once the angle of installation is determined, the locking pin 1433 is inserted into the appropriate holes 1432, and the angle of inclination of the ladders 12 is fixed.

Adjacent pairs of the ladder base securing devices 14 are mated together by tongue and groove fixtures 144 situated at each end of the securing device 14. The tongue and groove fixtures 144 are in alternating orientations, that is, a right side tongue and groove fixture 144 has a groove open to a top side, while a left side tongue and groove fixture 144 has a groove open to a bottom side. This conformation allows the pairs of ladder base securing devices 14 to be securely locked together, so that the bases of the ladders 12 are very stable. While it is envisioned that not more than two ladders 12 will typically be used in a given application, it should be readily recognized that as many ladders 12 and corresponding ladder base securing devices 14 as the user desires may be chained together to provide as much elevator mounting stability as may be desired.

Figure 21:
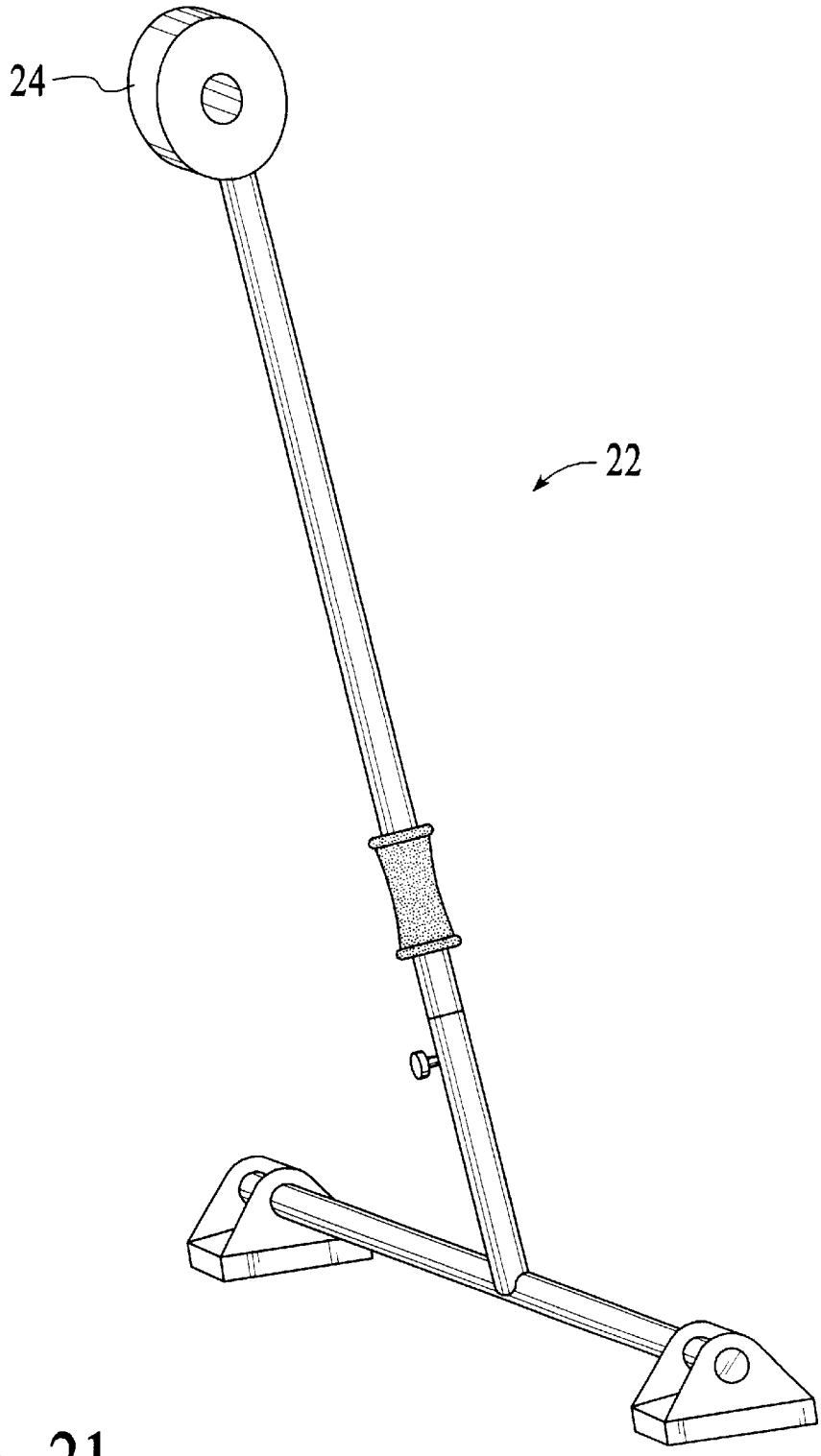
FIG. 21 is a perspective view of the T-bar support.

FIG. 21 shows the T-bar support 22 detached from the elevator assembly. This view shows the pivoting foot mounts that enable the T-bar support to be firmly anchored at any angle of installation. It should also be noted that rotatable grips can be added to the lateral extensions of the T-bar support to ease setup of the device.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A ladder elevator device comprising:

at least one ladder, at least one ladder attachment assembly, a lateral travel section, a vertical support member, and a raising, lowering, and laterally transporting device that travels back and forth on said lateral travel section and has a capacity to raise and lower a load; wherein said ladder attachment assembly secures said lateral travel section to said ladder, said lateral travel section is pivotally attached to said ladder attachment assembly such that an angle between said lateral travel section and said ladder attachment assembly is variable, and said vertical support member is pivotally attached to said lateral travel section such that an angle between said vertical support member and said lateral travel section is variable; so that said ladder elevator device is assembled with said angles between said lateral travel section and said ladder attachment assembly and said vertical support member being defined so as to provide maximum stability, said vertical support member rests on a work area surface and supports said lateral travel section in a substantially horizontal orientation.

2. The ladder elevator device of claim 1 wherein:

said ladder elevator device further includes a ladder stabilization bracket, said ladder stabilization bracket comprising:

at least one rung attachment means that secures said ladder stabilization bracket to said at least one ladder, a central mounting bar affixed to said rung attachment means, telescoping extension segments that extend outward from said central mounting bar when said extension segments are deployed, clamping arms attached to terminal units of said extension segments, and clamping mechanisms affixed to distal ends of said clamping arms; wherein said ladder stabilization bracket is affixed to said ladder below said ladder attachment assembly, and said clamping arms pivot about a longitudinal axis of said ladder stabilization bracket, said clamping mechanisms are secured to a member of said work area surface to further stabilize and secure said ladder elevator device.

3. The ladder elevator device of claim 2 wherein:

said clamping mechanisms comprise:

an inner jaw, an outer jaw, a sliding locking means, a release plate, a projecting grip, and a mounting rod; wherein said inner jaw and said outer jaw are mounted on said mounting rod, said locking means securing said inner jaw at a distance from said outer jaw such that a space equal to a width of said member of said work area surface to which said ladder stabilization bracket is attached, and said release plate is moved by said projecting grip from a locked position in which movement of said inner jaw is restricted to an unlocked position in which said inner jaw moves freely along said mounting rod.

4. The ladder elevator device of claim 1 wherein:

said ladder attachment assembly comprises at least two rung attachment means that secure said ladder attachment assembly to rungs of said ladder.

5. The ladder elevator device of claim 4 wherein:

said rung attachment means each comprise a pair of rung hooks.

6. The ladder elevator device of claim 1 wherein:

a base securing device is attached to a base of said at least one ladder.

7. The ladder elevator device of claim 1 wherein:

said base securing device comprises:

a base element, a pair of ladder rail sockets that receive a lower end of side rails of said ladder, and an angle locking means; wherein said angle locking means secures said ladder at an optimal angle relative to an installation surface for a given installation.

8. The ladder elevator device of claims wherein:

said angle locking means comprises:

a pair of parallel semicircular plates, a series of holes in said semicircular plates, and a locking pin that is inserted into one of said holes in said semicircular plates such that said locking pin contacts said side rails of said ladder so that said ladder is held at said optimal angle.

9. The ladder elevator device of claim 7 wherein:

each said base element comprises a tongue and groove fixture in each of two opposing sides thereof, said tongue and groove fixtures being in reverse orientation such that a left side tongue and groove fixture of a first unit of said base element meshes with a right side tongue and groove fixture of a second unit of said base element so that said first and second units of said base element are serially joined.

* * * * *